United States Patent [19]

Timmins

[11] 3,950,029

[45] Apr. 13, 1976

[54] IN SITU RETORTING OF OIL SHALE

[75] Inventor: Thomas H. Timmins, Dallas, Tex.

[73] Assignee: Mobil Oil Corporation, New York, N.Y.

[22] Filed: June 12, 1975

[21] Appl. No.: 586,470

[52] U.S. Cl. ..... 299/2; 166/256; 299/11; 299/19

[51] Int. Cl.[2] ..... E21B 43/24; E21B 43/26; E21C 43/00

[58] Field of Search ..... 299/2, 3, 4, 13, 11, 19; 166/256

[56] References Cited

UNITED STATES PATENTS

| | | | |
|---|---|---|---|
| 1,269,747 | 6/1918 | Rogers | 299/2 |
| 1,919,636 | 7/1933 | Karrick | 299/2 |
| 2,481,051 | 9/1949 | Uren | 299/2 |
| 2,630,306 | 3/1953 | Evans | 299/2 |
| 2,761,663 | 9/1956 | Gerdetz | 299/2 |
| 2,801,089 | 7/1957 | Scott, Jr. | 299/2 |
| 3,001,776 | 9/1961 | Van Poolen | 299/2 |
| 3,316,020 | 4/1967 | Bergstrom | 299/2 |
| 3,346,044 | 10/1967 | Slusser | 166/256 |
| 3,434,757 | 3/1969 | Prats | 299/2 |
| 3,588,175 | 6/1971 | Whiting | 299/11 |

*Primary Examiner*—Stephen J. Novosad
*Assistant Examiner*—George A. Suckfield
*Attorney, Agent, or Firm*—C. A. Huggett; Drude Faulconer

[57] ABSTRACT

An in situ retorting method and system for recovering hydrocarbons from an oil shale deposit. A retorting zone is formed in the deposit and is comprised of at least two galleries which are separated by a barrier of oil shale thick enough to prevent leakage of gas between galleries. A plurality of rooms are formed within each gallery and are defined by walls of oil shale having substantially less thickness than said barriers. As a gallery is completed, it is sealed and rubblized oil shale within the rooms of said gallery is retorted and the products recovered. Since the barriers between galleries protect workers against gas from a retorting gallery, work can continue on adjoining galleries while said gallery is being retorted.

10 Claims, 2 Drawing Figures

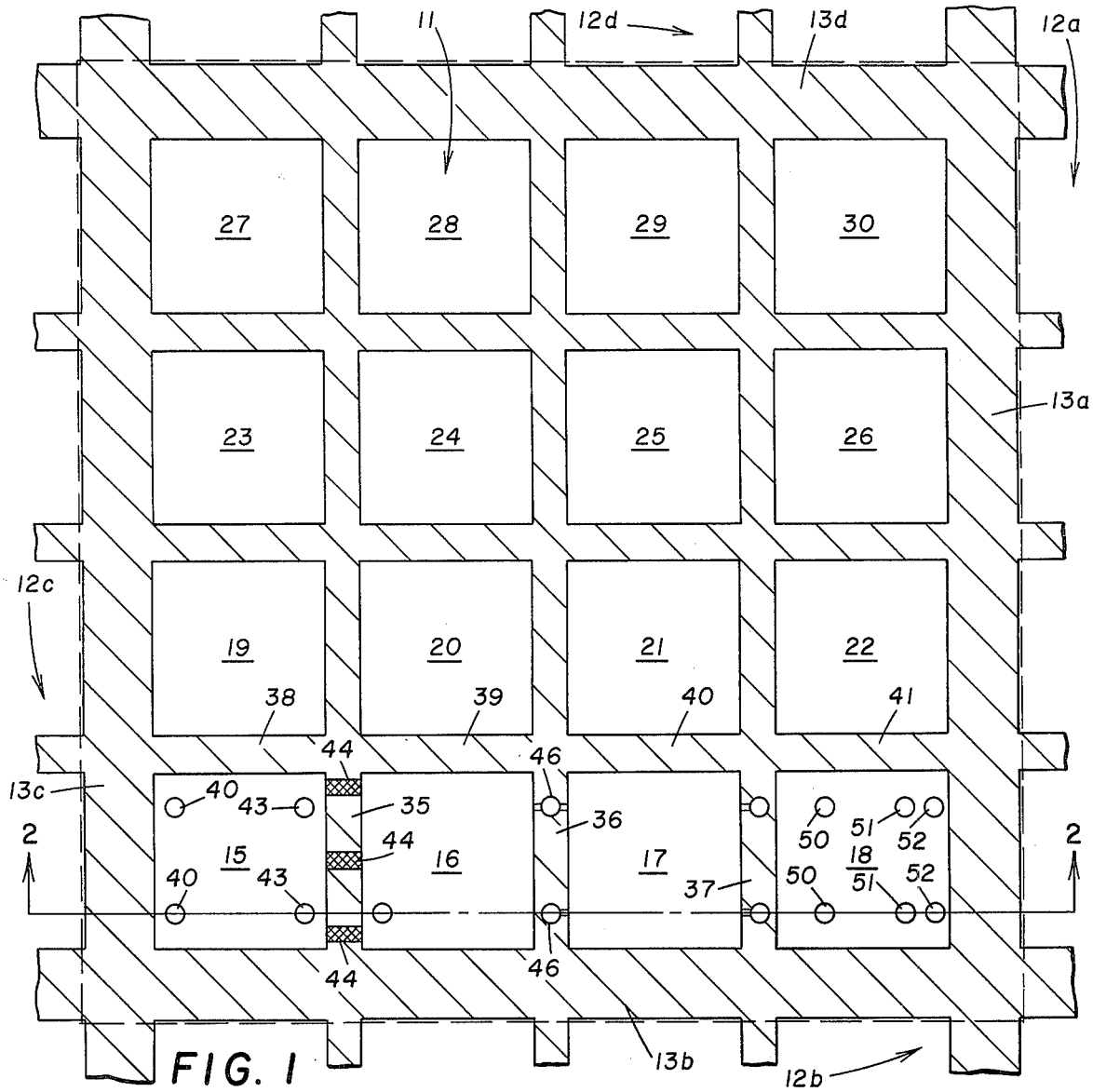
FIG. 1
FIG. 2
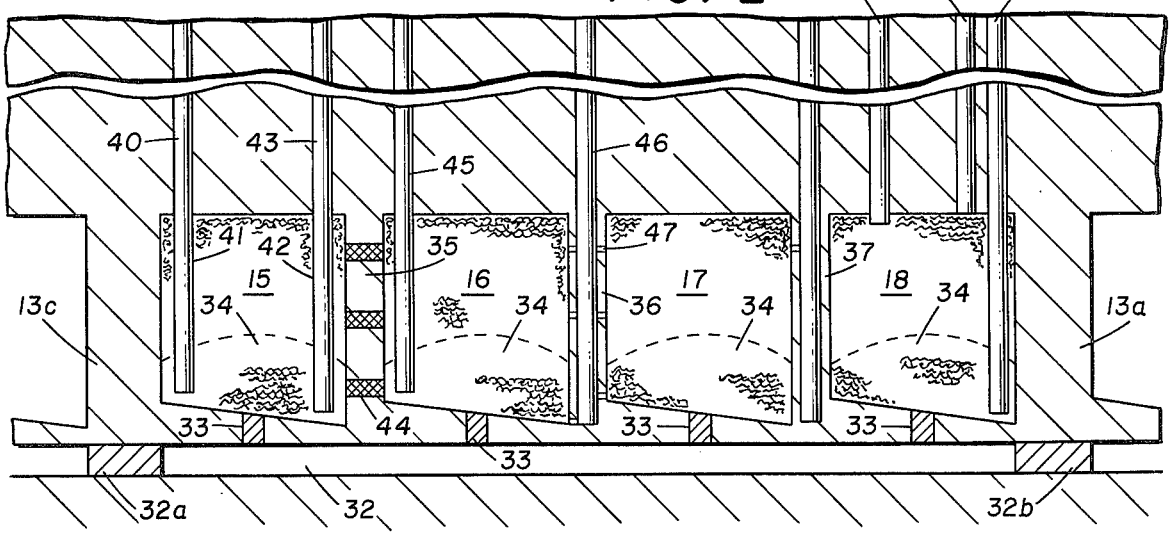

IN SITU RETORTING OF OIL SHALE

BACKGROUND OF THE INVENTION

This invention relates to a method for constructing an in situ retort zone in an oil shale deposit or the like and more particularly relates to an in situ retorting method and system for recovering products from an oil shale deposit or the like.

Oil shale deposits are shale formations wherein useful hydrocarbons exist in the form of "kerogen". While kerogen, which is a solid or semisolid, is for all practical purposes immobile within the shale, it is well known that liquid and gaseous hydrocarbons can be recovered by heating the oil shale. In recovering hydrocarbons from oil shale by use of heat, two basic techniques have evolved: surface retorting and in situ retorting.

Surface retorting involves mining the oil shale, transporting it to the surface, crushing the shale, and then passing it through a surface retort to extract the recoverable hydrocarbon products. Although surface retorting has been relatively successful in recovering hydrocarbons, problems inherent in this process (e.g., cooling and disposal of spent shale) have seriously deterred any widespread commercial application of this process.

In an in situ process, on the other hand, the retort zone is formed directly within the oil shale deposit. In accordance with known procedures, this zone normally takes the form of several individual rooms within a defined gallery area, each room being filled with rubblized shale for retorting. The rooms are formed by first removing a portion (e.g., 5 to 40%) of the shale within the defined room area and then rubblizing the surrounding shale into the void areas by explosives or other mining techniques. The rubblized shale is then retorted by either in situ combustion or by passing externally heated gas through the shale, and the resulting products are recovered through appropriate passages to the surface. Although the cooling and disposal problems inherent in surface retorting are substantially reduced in an in situ retorting process, other problems arise that must be considered in making an in situ operation commercially feasible.

Specifically, the retort zone should be constructed or laid out so that the maximum amount of the oil shale lying within the zone is actually subjected to retorting. This presents a problem since, in forming rooms of rubblized shale by present mining methods, it is necessary to leave substantial amounts of shale untouched in order to form the walls which define and separate the retort rooms. Due to the relatively impermeable nature of oil shale, only a minute portion of these solid walls will be retorted when the rubblized shale within a respective room is retorted, and the hydrocarbons in most of these walls will not be recovered. Therefore, for maximum utilization of the natural resources within a retort zone, the room walls should be formed so as to contain the least practical volume of shale; hence, they should be as thin as safety and operating procedures will allow.

However, as the thickness of the room walls decreases, the likelihood of such thin walls cracking or leaking during a retorting operation increases. Since it is desirable, at least from a commerical standpoint, to commence retort operations as soon as a gallery of rooms is ready, any off-gas from a room being retorted which might leak through a too thin or cracked room wall would pose a severe hazard to any personnel working in or preparing an adjoining room or gallery.

SUMMARY OF THE INVENTION

The present invention relates to a method of constructing an in situ retorting zone in an oil shale deposit and more particularly relates to an in situ retorting method and system for recovering hydrocarbon products from an oil shale deposit or the like, wherein the retort zone is constructed so that (1) personnel working in a gallery in the retort zone are protected against the off-gas from an adjoining gallery being retorted but, at the same time, (2) the maximum practical amount of oil shale within the retort zone is processed to recover hydrocarbon products therefrom.

In carrying out the present invention, a retort zone is formed in an oil shale deposit, the retort zone being comprised of two or more galleries adjacent one another within the deposit. These galleries are large areas, e.g., preferably from 500 to 5000 feet on a side, and are separated from each other by relatively thick barrier pillars, e.g., greater than 50 feet. These pillars, which in effect are actually walls, are formed by merely leaving portions of the oil shale untouched when constructing the galleries and must be thick enough to insure that there will be no leakage of gas from one gallery to another.

Within each gallery are a plurality of individual retort "rooms" having dimensions preferably of from 100 to 500 feet on a side, these rooms being separated from each other within a gallery by relatively thin room walls, e.g., less than 50 feet. The rooms may be formed by conventional mining techniques wherein a portion of the oil shale within a defined room area is removed to form a void into which the remaining shale within the room area is rubblized by explosions or the like. The room walls, which are formed by merely leaving portions of the oil shale intact, control the gas flow within each room during retorting so that high volumetric sweep efficiency can be obtained throughout the retort zone and so that the retorting gas temperature can be controlled for the best practical recovery of desired products. Also, since the room walls are relatively thin, the unretorted portions of these walls represent the smallest amount of unrecoverable products consistent with the necessary safety that must be provided during construction and retorting of the galleries. The room walls do provide some isolation from off-gas between the rooms in a gallery, but in the present method these walls do not have to be thick enough to prevent gas leakage to adjoining rooms under all circumstances. This is due to the fact that once a gallery of rooms is prepared and sealed, there will normally be no need for a worker to reenter the gallery. Further, since the barrier pillars between galleries are thick enough to prevent leakage of off-gas from one gallery to adjacent galleries, workers can safely work in or complete adjacent galleries while a previously completed gallery is being retorted.

To retort the individual rooms within a gallery, retorting gas is circulated from the surface, through the rubblized shale in a room, and then either returned directly to the surface or diverted to an adjacent room to preheat the shale in that room and to cool the gas before it is returned to the surface. The off-gas can be diverted to an adjoining room by detonating explosive charges properly placed in the room walls to establish communication between rooms after a room has been retorted sufficiently to produce a high temperature (e.g., >200° F.) off-gas. The explosive charges are sealed in the room walls during construction of the room. Communication passages are provided to supply the retorting gas to rooms and to remove the products resulting from the retorting.

The actual techniques of supplying the necessary heat for retorting the shale can be carried out by in situ combustion or by circulating hot retorting gas, both techniques being well known in the art. In the present invention, "retorting gas" as used herein shall mean recycled retort off-gas, inert gas, air, oxygen, or any combination of the above and it may or may not be heated on the surface prior to injection.

BRIEF DESCRIPTION OF THE DRAWINGS

The above-mentioned and other apparent advantages of the invention will be more readily appreciated as the invention becomes better understood by reference to the following detailed description when considered in connection with the accompanying drawings wherein:

FIG. 1 is a perspective plan view, partly in section, of a retort zone constructed in accordance with the present invention; and FIG. 2 is a perspective, sectional view taken along line 2—2 of FIG. 1.

DESCRIPTION OF THE PREFERRED EMBODIMENTS

Referring more particularly to the drawings, FIG. 1 discloses a plan view of a retort zone within an oil shale deposit or the like in accordance with the present invention. The retort zone is comprised of a plurality of adjoining galleries 11, 12*a*, 12*b*, 12*c*, 12*d* having common barrier pillars 13*a*, 13*b*, 13*c*, 13*d*, respectively, forming thick walls therebetween. Preferably, the galleries range in size from 500 to 5000 feet on a side (depending on the overall size of the deposit, the quality of oil shale, accepted engineering practices, etc.) and may be square (as illustrated), rectangular, or may take some other appropriate configuration. For reasons explained more fully below, barrier pillars 13*a*–13*d* separating the galleries are relatively thick, i.e., over 50 feet thick, preferably between 50 and 100 feet.

Within each gallery (only gallery 12 will be fully described) are a plurality of retort rooms 15–30, inclusive. Although sixteen rooms are illustrated, it should be understood that more or less rooms can be provided within a gallery without departing from the present invention. Conventional mining techniques may be used to form the individual rooms and the actual techniques used form no part of the present invention. For example, a central, vertical mine shaft or adit tunnel (not shown) can be extended from the surface into the oil shaft deposit and mine drifts 32 (FIG. 2) can be driven under and/or over (not shown) the gallery site. The individual rooms are then formed by removing a portion of the shale (e.g., 5 to 40%) within a defined room area through raises 33 to create a void, illustrated by dotted line 34, and rubblizing the remaining shale within the room area into the void and room area by explosives or similar known techniques. The shale that is mined to form tunnels, drifts and the voids in the rooms is removed to the surface through the adit where it can be processed by known surface retorting techniques. For a more complete description of similar mining techniques, seen U.S. Pat. Nos. 3,001,776; 2,481,051; and 1,919,636.

Rooms 15–30 within gallery 11 preferably range in size from 100 to 500 feet on a side and may be square (as shown), rectangular, or may be of other configuration consistent with the overall retort zone. The bottoms of the rooms are preferably inclined as shown in FIG. 2 to provide a sump in each room for collection of liquid products which will be discussed more fully below.

The room walls, e.g., 35–41, which separate the rooms consist of undisturbed shale and are formed so that they contain the minimum amount of shale consistent with safety and efficient operating procedures. Where the room size is from 100 to 500 feet on a side, these walls will normally be less than 50 feet thick, preferably ranging from 20 to 50 feet, depending on in situ conditions. In all cases, however, the room walls will be substantially thinner than the barrier pillars. In addition to defining the rooms, the primary purpose of these room walls is to control the flow of the retorting gas within each room during retorting so that high volumetric sweep efficiency is maintained and so that the retorting gas temperature can be controlled to obtain the highest practical retorting yields of liquid products. For example, by limiting the retorting distance in any one room, the temperature gradient across the retorting zone is kept relatively high. As a result, liquid shale oil yields are relatively high and coke and gas by-product yields are minimized. The room walls also provide some isolation of toxic or noxious gases between rooms, but these walls do not have to be thick enough to prevent gas leakage to adjoining rooms under all circumstances.

In constructing the retort zone of the present invention, as a gallery is completed, e.g., 11, it is sealed by blocking drift 32 at 32*a*, 32*b*, FIG. 2. Gallery 11 is now ready for retorting and at the same time personnel can continue work on adjoining galleries.

To actually retort the rubblized shale in a retort room within gallery 11, different embodiments of heating steps can be utilized. In the preferred embodiment, one or more communication passages, e.g., inlet wells 40, are completed from the surface to the bottom of room 15, as shown. The cased portion 41 of each well 40 extends through room 15 and is perforated along its length so that retorting gas circulated from the surface can flow into room 15. The retorting gas will flow substantially horizontally across room 15 to retort the shale in room 15 and will be circulated back to the surface through perforations (not shown) in the cased portions 42 of one or more outlet wells 43.

As mentioned above, "retorting gas" as referred to throughout all embodiments of this invention may be air, oxygen, recycled retort off-gas, inert gas, or any combination of the above, and it may or may not be heated on the surface prior to injection into a room, or it may be supplied to fuel and/or support in situ combustion within the rubblized shale. Both in situ combustion and hot inert gas retorting processes are well known and no further description is considered necessary.

As the retorting gas moves from inlet well 40 to outlet well 43, the rubblized shale will be heated to release (1) gaseous hydrocarbons which will normally be recovered along with the circulating retorting gas, and (2) liquid products which seep downward through the shale in room 15 and are collected in the sump at the low side of the room. The liquid products are then removed through outlet well 43, e.g., a tubing and pump (not shown) can be positioned through well 43 to lift the products from the sump as is well known in the production art.

In the present invention, when the retort off-gas exiting from room 15 reaches a temperature (e.g., greater than 200° F.) at which the gas can no longer be handled in standard surface facilities without cooling, explosive charges 44 are detonated to blast holes through room wall 35. These explosive charges are placed in the room walls when the rooms are being formed and are detonated by remote control, temperature sensors, or other known techniques. Once explosives 44 are detonated, outlet wells 43 are closed to gas flow and the off-gas from room 15 passes through the openings in room wall 35 into the rubblized shale in room 16. The gas travels across room 16, giving up heat to the shale in room 16, and flows back to the surface through output wells 46.

Output wells 46, as illustrated in FIG. 2, illustrate a modification of the communication passage between the surface and the room that can be utilized in the present invention. Wells 46 are drilled directly into the room walls and communicate with room 16 through small adits 47. Likewise, it should be recognized that in the present invention, all necessary input wells may be constructed in the same manner as output well 46 or a combination of wells 41, 42, and/or 46 can be used in completing a particular retort zone.

After the desired retorting of room 15 has been completed, injection of gas through input well 40 is ceased and gas injection is started through inlet wells 45 directly into room 16. As an individual room undergoes retorting, the above procedure is repeated until all rooms within a gallery are retorted. Further, where a well, e.g., 46, is completed through a room wall, it may first serve as an output well for one room, e.g., 16, and then be converted into an injection well for an adjacent room 17.

Another modification of the retorting operation is illustrated in connection with room 18, FIG. 2. Injection wells 50, 51 are completed into the top of room 18 with output wells 52 (only one shown) being completed as described in relation to output well 42 above. Retorting gas is injected via wells 50, 51 so that the retorting front moves vertically as opposed to horizontally, as previously described.

By reducing the room walls to a minimum thickness to insure initial safety to the miners while they are forming the rooms but not requiring the room walls to be thick enough to prevent leakage of gas under all conditions, it is estimated that as much as 15 per cent or more of the products available from the shale within a defined retort zone can be recovered which otherwise would remain unrecovered if presently known barrier and pillar designs were utilized. The miner's safety is still insured in the present invention by completing an entire gallery and sealing same before any retorting is commenced in that gallery. The barrier pillars, being of sufficient thickness to prevent leakage of retorting off-gas from one gallery to another, protect the personnel working in adjacent galleries while the sealed gallery is being retorted.

What is claimed is:

1. A method of constructing a retorting zone in an oil shale deposit or the like, said method comprising:

forming at least two galleries within said deposit adjacent one another and separated by a barrier pillar, said barrier pillar being formed from said oil shale and being of sufficient thickness to prevent leakage of gas between said galleries; and forming a plurality of rooms within each of said galleries, each room within its respective gallery being defined and separated by room walls, said room walls being formed from said oil shale and being of substantially less thickness than said barrier pillars.

2. A method of recovering hydrocarbons from an oil shale deposit or the like comprising:

constructing a retorting zone within said deposit, said retorting zone upon construction comprising:

at least two galleries lying adjacent one another and separated by a barrier pillar, said barrier pillar formed from said oil shale and being of sufficient thickness to prevent the leakage of gas between galleries;

a plurality of rooms within each of said galleries, each of said rooms being filled with rubblized shale and being defined and separated by room walls, said room walls being formed from said oil shale and being of substantially less thickness than said barrier pillars;

heating said rubblized shale in each of said rooms; and recovering the products produced from said shale.

3. The method of claim 2 wherein the step of heating said rubblized shale comprises:

circulating retorting gas through inlet communication passages into a room and recovering the retorting gas as off-gas through outlet communication passages from said room.

4. The method of claim 3 including:

completing said inlet and said outlet communication passages from the surface to said rooms into said room walls.

5. The method of claim 3 including:

diverting said off-gas from said room to a second room whenever the temperature of said off-gas exceeds that which can be handled at the surface without cooling.

6. The method of claim 5 wherein the step of diverting said off-gas comprises:

detonating explosives within the room wall separating said room and said second room to establish communication therebetween.

7. The method of claim 2 wherein one of said galleries is completed and sealed before an adjoining gallery is completed.

8. The method of claim 7 wherein the heating of the shale in said completed and sealed gallery is commenced before said adjoining gallery is completed.

9. A retorting system for recovering hydrocarbon products from an oil shale deposit or the like, said system comprising:

a retorting zone within said deposit having at least two galleries lying adjacent one another;

a barrier pillar separating said adjacent galleries, said barrier pillar being formed from undisturbed oil shale and being of a thickness to prevent gas from leaking from one gallery to another;

a plurality of rooms within each gallery, said rooms being defined by room walls formed from undisturbed shale and being of a thickness substantially less than said barrier pillar;

rubblized shale in each of said rooms and inlet communication passages into each of said rooms for the injection of retorting gas; and outlet communication passages into each of said rooms for recovering hydrocarbon products from said rooms.

10. The system of claim 9 wherein said inlet and said outlet communication passages are completed into said room walls.

* * * * *